United States Patent [19]

Sharma et al.

[11] Patent Number: 4,964,881

[45] Date of Patent: Oct. 23, 1990

[54] CALCIUM IMPREGNATION OF COAL ENRICHED IN $CO_2$ USING HIGH-PRESSURE TECHNIQUES

[75] Inventors: Pramod K. Sharma, La Canada; Gerald E. Voecks, La Crescenta; George R. Gavalas, Altadena, all of Calif.

[73] Assignee: The California Institute of Technology, Pasadena, Calif.

[21] Appl. No.: 309,656

[22] Filed: Feb. 13, 1989

[51] Int. Cl.[5] ..... C10L 9/02

[52] U.S. Cl. ..... 44/620; 44/604

[58] Field of Search ..... 44/620, 604

[56] References Cited

U.S. PATENT DOCUMENTS

| | | | |
|---|---|---|---|
| 4,204,843 | 5/1980 | Neavel | 44/620 |
| 4,280,817 | 7/1981 | Chauhan et al. | 44/604 |
| 4,468,231 | 8/1984 | Bartok et al. | 44/604 |
| 4,522,626 | 6/1985 | Espenscheid | 44/620 |

FOREIGN PATENT DOCUMENTS

| | | | |
|---|---|---|---|
| 1158241 | 5/1985 | U.S.S.R. | 44/620 |

OTHER PUBLICATIONS

"Sulfur Retention . . . . " by Freund et al. 9/81.

"Sulfur Retention of Calcium-Containing Coal . . . " by Freund et al. 1982.

Chang "Fuel", vol. 65, p. 75—86.

"Calcium Pretreatment of Coal" by Sharma et al., 2/87.

*Primary Examiner*—Carl F. Dees

*Attorney, Agent, or Firm*—Thomas N. Giaccherini

[57] ABSTRACT

Methods are described for impregnating coal with calcium carbonate by utilizing an aqueous phase ionic reaction between calcium acetate, calcium hydroxide, and water with $CO_2$ contained within the coal. The coal is enriched in $CO_2$ by contacting it with $CO_2$ at high pressure, in either a continuous or pulsed mode. The inclusion of $CO_2$ in the coal during the process does not involve evacuating the coal and subsequently absorbing $CO_2$ onto the coal as in prior methods. Rather, the coal is treated with carbon dioxide at high pressure in a practical and viable approach. The impregnation of coal by calcium compounds not only reduces sulfur emissions by effectively tying up the sulfur as calcium sulfide or sulfate, but also increases the gasification or combustion rate. The invention also encompasses the use of other Group IIA elements, as well as the coal products resulting from the methods of treatment described.

29 Claims, 2 Drawing Sheets

CALCIUM IMPREGNATION OF COAL ENRICHED IN $CO_2$ USING HIGH-PRESSURE TECHNIQUES

ORIGIN OF THE INVENTION

The invention described herein was made in the performance of work under a NASA contract, and is subject to the provisions of Public Law 96-517 (35 USC 202) in which the Contractor has elected to retain title.

TECHNICAL FIELD

The invention relates to methods of impregnating coal with elements from Group IIA of the periodic chart, and in particular to such methods involving the impregnation of coal with calcium.

BACKGROUND ART

In the field of energy production technology, methods for better and safer fossil fuel utilization occupy an important position. The "energy crisis" resulting from man's ever increasing demands for energy places a premium on finding ways of economically but cleanly consuming fossil fuels. Because of the immense coal reserves which exist on earth, large quantities of coal are used in the production of energy. Methods of efficiently burning or gasifying coal with reduced harmful emissions to the atmosphere are therefore of major importance.

Sulfur in coal is a major source of polluting emissions, in the form of $SO_2$ when coal is burned and $H_2S$ when coal is gasified. The use of calcium in sulfur-containing coal as a means of preventing the release of gaseous sulfur compounds during combustion has been widely investigated. For example, see the article by Freund et al. entitled "*The Sulfur Retention of Calcium-Containing Coal during Partial Oxidation*," in Proceedings of the International Conference on Coal Science, held Sept. 7–9, 1981 in Dusseldorf, Germany; the article by Freund and Lyon entitled "*The Sulfur Retention of Calcium-Containing Coal during Fuel-Rich Combustion*," in the journal COMBUSTION AND FLAME, Volume 45, pp. 191–203, published in 1982; and the article by Chang et al. in the journal FUEL, Volume 65, at page 75, published in 1986. The methods for adding calcium to coal which have been proposed have included limestone injection and ion exchange between the coal and a calcium solution at a suitable pH.

More recently Sharma et al. have proposed an alternate method of treating coal with calcium, described in the article "*Calcium pretreatment of coal for sulphur emissions control in combustion*," in the journal FUEL, Volume 66, pp. 207–209, published in February of 1987. The proposed process utilizes a liquid-phase ionic reaction between $Ca^{2+}$, $CO_2$, and $H_2O$ to deposit submicron-size $CaCO_3$ particles in coal pores. An aqueous-phase reaction between $CO_2$ (contained within the coal's pore network) and calcium acetate takes place in which calcium replenishment is provided by calcium hydroxide. In this method proposed by Sharma et al. the inclusion of $CO_2$ within the coal is achieved by first evacuating the coal (by means of a vacuum pump) and then adsorbing $CO_2$ onto the coal by contact with $CO_2$ at or near a pressure of one atmosphere. The individual and overall reactions in the impregnation process are described as:

$$Ca(CH_3COO)_2 + H_2O + CO_2 \rightarrow CaCO_3 + 2CH_3COOH$$
$$2CH_3COOH + Ca(OH)_2 \rightarrow Ca(CH_3COO)_2 + 2H_2O$$
$$Ca(OH)_2 + CO_2 \rightarrow CaCO_3 + H_2O$$

The economics of the impregnation process is favorably influenced by the fact that the solubilizing anion, acetate, is not consumed in the process. However, the proposed process involves evacuating the coal and then adsorbing $CO_2$ on it, a process which is not economically practical. The step in which coal is evacuated prior to $CO_2$ adsorption will be costly considering the large amounts of coal handled in industry.

If a method could be found which makes use of the chemical processes suggested by Sharma et al., but which is simpler and economically feasible, it would be a great advance in the field of coal combustion technology, since it would allow for very efficient and clean utilization of coal as an energy source.

STATEMENT OF THE INVENTION

Accordingly, it is an object of the invention to provide methods of economically processing coal which not only greatly increase the gasification or combustion rate of the coal, but also reduce the sulfur emissions therefrom, by impregnating the coal with calcium. The methods involve impregnating the coal with calcium carbonate, but the inclusion of $CO_2$ in the coal does not involve evacuating the coal and subsequently adsorbing $CO_2$ onto the coal as in prior methods. Rather, the coal is treated with carbon dioxide at high pressure, which is a much more practical approach.

Techniques are described for impregnating coal with calcium carbonate by utilizing an aqueous phase ionic reaction between calcium acetate, calcium hydroxide, and water with $CO_2$ contained within the coal. The coal is enriched in $CO_2$ by contacting it with $CO_2$ at high pressure, in either a continuous or pulsed mode, which is a practical and viable approach.

Two groups of methods in accordance with the invention can be distinguished. In the first group of methods $CO_2$ gas under a steady pressure is applied to coal for a predetermined length of time to effect the adsorption of the gas onto the exterior surface of the coal as well as onto the "interior" surfaces provided by pores and cracks in the coal. The second group of methods employs pulsed-pressure techniques to achieve the same ends. Cyclical pressurization and de-pressurization of the coal with $CO_2$ gas is carried out according to a schedule of times and pressures designed to enhance the penetration of the gas into interstices in the coal.

The impregnation of coal by calcium compounds has been shown to have a great deal of value in gasification and combustion. One important benefit is in reducing the sulfur emissions by effectively tying up the sulfur as calcium sulfide. The other benefit is to greatly increase the gasification or combustion rate.

The methods described below in detail include several embodiments of the invention, in which coal is impregnated with $CaCO_3$ via inclusion of $CO_2$ in the coal and does not involve evacuation of the coal but rather proceeds through a practical and commercially viable approach of treating the coal with high-pressure $CO_2$.

One embodiment of the invention involves pressurizing the coal with $CO_2$ at a pressure of from 2 to 10 atmospheres, de-pressurizing the coal, and then rapidly contacting it with a water slurry consisting of calcium acetate solution and suspended $Ca(OH)_2$.

Another embodiment of the invention involves a pretreatment of coal before pressurization and contacting with calcium acetate, $Ca(OH)_2$, and $H_2O$ as described above. The coal pretreatment involves heating the coal to a temperature of 40 to 60 degrees Centigrade for an effective period of time, perhaps 24 hours. This step is designed to remove moisture from the coal, which may interfere with $CO_2$ adsorption.

A third embodiment of the invention involves pulse pressurization of coal with $CO_2$, which can be applied to coal which has not received a heat pretreatment as well as to coal that has received a heat pretreatment. The objective of the rapid sequence of pressurization and de-pressurization is to replace water and preadsorbed gases in coal with $CO_2$ prior to the calcium impregnation reaction.

The invention also encompasses the use of other Group IIA elements besides calcium, as well as the coal products resulting from the methods of treatment described.

An appreciation of other aims and objectives of the present invention and a more complete and comprehensive understanding of this invention may be achieved by studying the following description of a preferred embodiment and by referring to the accompanying drawings.

DETAILED DESCRIPTION OF THE INVENTION

Figure 1:
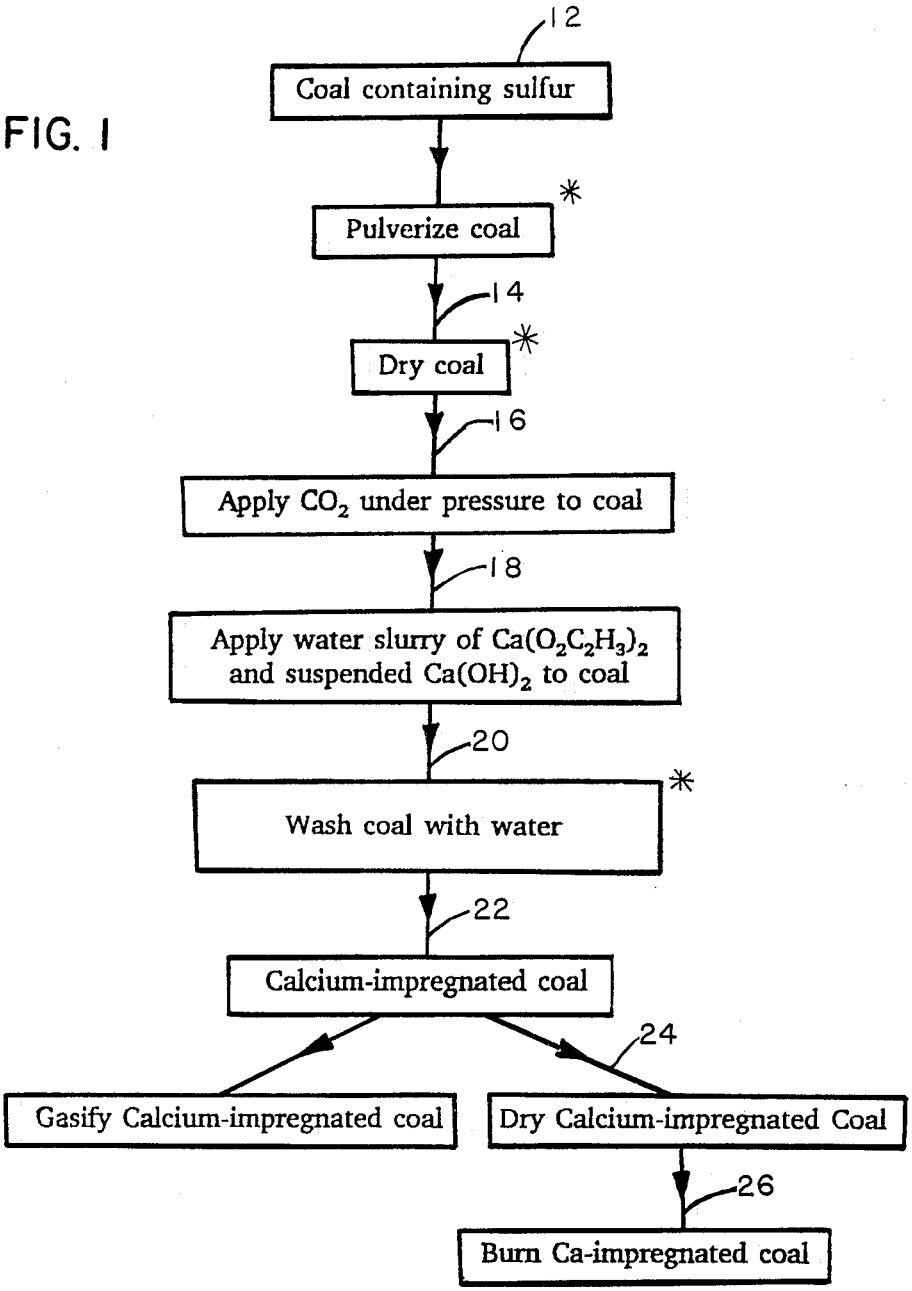
FIG. 1 is a schematic flow diagram of a first group of methods in accordance with the invention of impregnating $CO_2$-enriched coal with calcium, with blocks marked with an asterisk representing optional steps.
Figure 2:
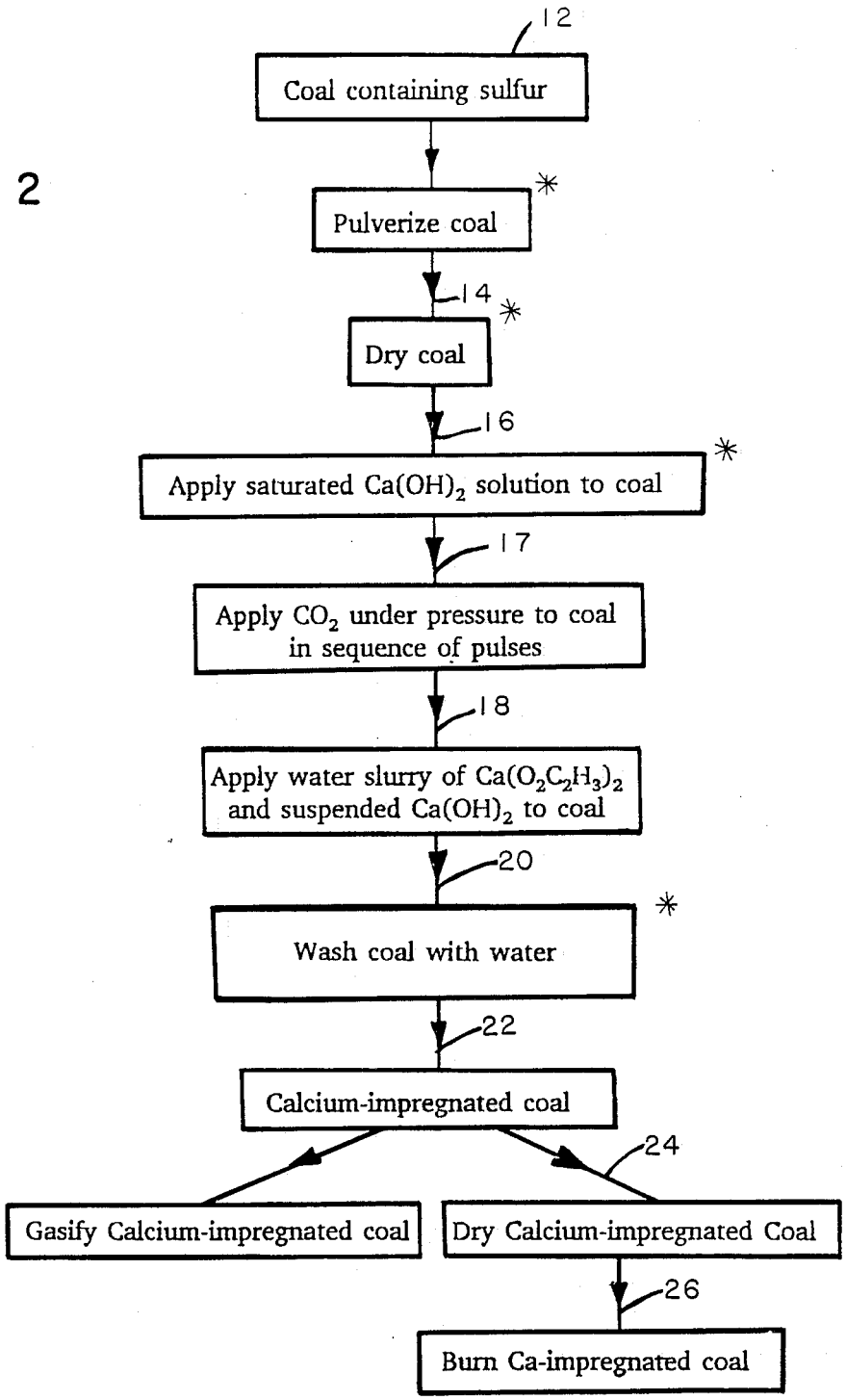
FIG. 2 is a schematic flow diagram of a second group of methods in accordance with the invention of impregnating $CO_2$-enriched coal with calcium, with blocks marked with an asterisk representing optional steps.

FIGS. 1 and 2 are flow diagrams in schematic form outlining methods of impregnating coal with calcium in accordance with the invention. There are several possible variations on two main themes, and this is reflected in the boxes marked with an asterisk in FIGS. 1 and 2, which denotes steps which are optional in certain embodiments of the invention. The invention also encompasses coal treated by the various methods disclosed below.

With reference first to FIG. 1, methods involving the application of a steady pressure of carbon dioxide gas as part of the calcium-impregnation process will be described. The methods of treatment start out with sulfur-containing coal 12 which is desired to be gasified or burned without the release of hydrogen sulfide or sulfur dioxide into the atmosphere.

Because it is desired to introduce as much calcium as possible into the coal 12, the surface area of the raw coal may be increased by a step of finely dividing the coal pieces to produce pulverized coal 14. For coal that will be ultimately gasified, pulverization into coal particles having sizes predominately in the range from 100 to 1000 microns is suitable. For coal that is to be burned, finer particles are desirable; pulverizing the starting coal to particles having sizes predominately in the range from 10 to 100 microns is appropriate.

A step of drying the pulverized coal 14 has the goal of removing as much water vapor as possible so that a maximum amount of carbon dioxide can be later adsorbed onto the coal. One way to produce dried coal 16 is by heating the coal for about 24 hours at a temperature in the range from 40 to 60 degrees C.

The next step is one of the main steps in calcium-impregnation processes in accordance with the invention. The coal, whether raw coal 12, pulverized coal 14, or dried pulverized coal 16, is subjected to carbon dioxide gas under pressure for a predetermined period of time. The pressure of carbon dioxide gas can be in the range from 2 to 10 atmospheres and the length of time the pressure is applied can be about 24 hours. After the pressure is removed, the result is coal 18 with $CO_2$ adsorbed onto its surfaces, including interstices such as pores and cracks.

Next the coal 18 with $CO_2$ adsorbed onto its surfaces is contacted with an aqueous slurry of calcium hydroxide and calcium acetate. This can be accomplished in various ways, including spraying the slurry onto the coal or mixing the coal into the slurry. The slurry may also be introduced under pressure. The slurry-contacted coal 20 can be optionally treated by a final step of washing with water to produce washed slurry-contacted coal 22.

The slurry-contacted coal 20 or washed slurry-contacted coal 22 comprises calcium-impregnated coal 24, due to the chemical reactions described above that cause precipitation of calcium carbonate on the inner and outer surfaces of the coal particles. If the calcium-impregnated coal 24 is to be gasified it can be utilized directly while still wet. Anticipating utilization of the calcium-impregnated coal 24 for burning dictates an additional step of drying to yield dried calcium-impregnated coal 26.

With reference next to FIG. 2, methods involving the application of pulsed carbon dioxide gas pressure as part of the calcium-impregnation process will be described. These methods of treatment begin with sulfur-containing coal 12 which is intended to be ultimately gasified or burned cleanly and efficiently, with the impregnated calcium tying up the sulfur as calcium sulfide or sulfate to prevent the release of hydrogen sulfide or sulfur dioxide gases.

The introduction of as much calcium as possible into the coal 12 is desirable, so that the surface area of the raw coal may be increased by crushing or grinding the coal into pulverized coal 14. Pulverization into coal particles having sizes predominately in the range from 10 to 100 microns is recommended for coal destined for burning. Reducing the starting coal to particles having sizes predominately in the range from 100 to 1000 microns is more appropriate for coal that is to undergo gasification; coarser particles are desirable in that case.

Removing as much water vapor as possible from the pulverized coal 14 allows a large amount of carbon dioxide to be adsorbed onto the coal when the coal is exposed to carbon dioxide gas under pressure in a later step of the calcium-impregnation treatment. An optional step of drying the pulverized coal 14 thus follows. The production of dried coal 16 may be effected, for example, by heating the coal at a temperature in the range from 40 to 60 degrees C. for a given length of time, say for 24 hours.

The next step of the flow diagram of FIG. 2 is one of the principal ones in this alternative group of calcium-impregnation processes in accordance with the invention. The coal, whether raw coal 12, pulverized coal 14, or dried pulverized coal 16, is pulse-pressurized by carbon dioxide gas. The pulse-pressurization treatment comprises applying carbon dioxide gas under pressure to, and then reducing the pressure on, the coal a predetermined number of times for predetermined lengths of time.

The cyclical pressurization and de-pressurization of the coal aids in more effectively infiltrating the carbon dioxide gas into the interstitial spaces inside the coal communicating with the outer surface, such as pores and cracks. There the $CO_2$ gas can be adsorbed onto interior surfaces, resulting in a more uniform distribution of calcium in the coal when calcium carbonate is later deposited by the chemical reactions made use of by the invention. Appropriate pressures of carbon dioxide gas in the pulse-pressurization process can be in the range from 2 to 10 atmospheres. The pressure can be applied in a pulse that ranges in time from minutes to hours.

After the pulse-pressurization has been carried out for a suitable number of cycles, coal 18 is produced with $CO_2$ adsorbed onto its surfaces, including interstices such as pores and cracks. The coal 18 with $CO_2$ adsorbed onto its surfaces is subsequently exposed to a slurry of calcium hydroxide and calcium acetate in water, as for example by mixing the slurry with the coal 18 or spraying the slurry onto the coal 18. As a result of the slurry being imbibed into the pores and cracks of the coal 18, calcium carbonate precipitates out wherever carbon dioxide gas has been previously adsorbed.

A final optional step of washing with water produces washed slurry-reacted coal 22. The slurry-reacted coal 20 or washed slurry-reacted coal 22 is calcium-impregnated coal 24, due to the chemical reactions described above that cause precipitation of calcium carbonate on the inner and outer surfaces of the coal particles. The calcium-impregnated coal 24 can be made use of directly while still wet if it is desired to gasify it. The calcium-impregnated coal 24 can be subjected to an additional step of drying to yield dried calcium-impregnated coal 26 if it is planned to burn the coal.

EXAMPLE

A high-volatile bituminous coal of a sulfur content of 3.36 weight percent is pulverized and sieved in the size range of 40 to 100 microns. One ton of this coal is contacted with hot air at 50 degrees Centigrade for 24 hours in order to dry the coal. The dried coal is transferred to a pressure vessel and pressurized with $CO_2$ at 5.0 atmospheres pressure. One ton of a slurry consisting of a 1.0N solution of calcium acetate in water and 0.116 ton of suspended calcium hydroxide is introduced into the pressure vessel at 5.0 atmospheres. The entire mixture in the pressure vessel is vigorously stirred for ten minutes. After that the contents are filtered and the treated coal is separated from the solution. The treated coal is expected to be impregnated with $CaCO_3$ corresponding to a Ca/S molar ratio of 1.50. The separated solution is reused in the next impregnation of coal with the addition of a small amount of makeup acetic acid, about 0.004 tons.

The invention in its broader aspects comprises methods of impregnating coal with any element from Group IIA of the periodic table of the elements, as well as treated coal products resulting from such methods. If E stands for an element belonging to Group IIA of the periodic table of the elements, then the reactions represented by the following chemical equations will apply in the methods of the present invention:

$$\begin{array}{c} E(CH_3COO)_2 + H_2O + CO_2 \rightarrow ECO_3 + 2CH_3COOH \\ 2CH_3COOH + E(OH)_2 \rightarrow E(CH_3COO)_2 + 2H_2O \\ \hline E(OH)_2 + CO_2 \rightarrow ECO_3 + H_2O \end{array}$$

First, $CO_2$ gas is adsorbed onto the coal by high-pressure techniques. Then, a slurry comprising water, a Group IIA element hydroxide, and a Group IIA element acetate is applied to the coal. The carbonate of the Group IIA element is formed wherever adsorbed $CO_2$ was present.

The Group IIA element calcium has been emphasized above because it has been found to be particularly useful in the gasification and combustion of sulfur-containing coal, as described under "Background Art." Calcium not only acts as a catalyst to promote more efficient energy production, but also ties up sulfur from the coal as the sulfide or sulfate of calcium so that it is not released as a gaseous compound.

Hydrogen sulfide and sulfur dioxide, two of the most common gaseous compounds of sulfur, are poisonous to animals and plants. In most cases $H_2S$ will be burned to $SO_2$ during coal utilization. When washed from the atmosphere by rainfall $SO_2$ is harmful to the environment, as in the well-known acid rain problem. Methods of impregnating coal with calcium and the treated coal resulting therefrom are of the utmost significance in relation to the efficient and clean production of energy for the needs of our civilization.

The above-described embodiments are furnished as illustrative of the principles of the invention, and are not intended to define the only embodiment possible in accordance with our teaching. Rather, the invention is to be considered as encompassing not only the specific embodiments shown, but also any others falling within the scope of the following claims. For example, other solubilizing anions besides the acetate ion are also suitable for use in the chemical treatment processes described above. The formate ion is one such solubilizing ion.

What is claimed is:

1. A method comprising:

(a) applying carbon dioxide gas under pressure to coal;

(b) removing said pressure; and (c) applying a slurry comprising water, a Group IIA element hydroxide, and a Group IIA element acetate to said coal.

2. The method of claim 1 wherein said Group IIA element is calcium.

3. The method of claim 1 wherein a Group IIA element formate is used instead of said acetate.

4. The method of claim 1 additionally comprising drying said coal before application of said carbon dioxide gas under pressure.

5. The method of claim 4 wherein said drying comprises heating said coal for for at least 24 hours at a temperature in the range from 40 to 60 degrees C.

6. The method of claim 1 additionally comprising a final step of washing said coal with water.

7. The method of claim 1 additionally comprising an initial step of pulverizing said coal.

8. The method of claim 7 wherein said pulverizing results in coal particles having sizes predominately in the range from 10 to 100 microns.

9. The method of claim 7 wherein said pulverizing results in coal particles having sizes predominately in the range from 100 to 1000 microns.

10. The method of claim 1 wherein said pressure of said carbon dioxide is in the range from 2 to 10 atmospheres and said pressure is applied for about 24 hours.

11. A method of treating coal comprising:

(a) applying carbon dioxide gas under pressure to, and then removing said pressure from, said coal cyclically in a process including at least one cycle; and (b) applying a slurry comprising water, a Group IIA element hydroxide, and a Group IIA element acetate to said coal.

12. The method of claim 11 wherein said Group IIA element formate is used instead of said acetate.

13. The method of claim 11 wherein said Group IIA element is calcium.

14. The method of claim 11 additionally comprising drying said coal before application of said carbon dioxide gas under pressure.

15. The method of claim 14 wherein said drying comprises heating said coal for at least 24 hours at a temperature in the range from 40 to 60 degrees C.

16. The method of claim 11 additionally comprising a final step of washing said coal with water.

17. The method of claim 11 additionally comprising an initial step of pulverizing said coal.

18. The method of claim 17 wherein said pulverizing results in coal particles having sizes predominately in the range from 10 to 100 microns.

19. The method of claim 17 wherein said pulverizing results in coal particles having sizes predominately in the range from 100 to 1000 microns.

20. The method of claim 11 wherein said pressure of said carbon dioxide is in the range from 2 to 10 atmospheres.

21. The method of claim 20 wherein said pressure is applied for approximately 24 hours.

22. A method of impregnating coal with calcium comprising:

(a) pulverizing said coal to particles having sizes predominately in the range from 10 to 1000 microns;

(b) applying carbon dioxide gas under pressure to, and then removing said pressure from, said coal cyclically in a process including at least one cycle; and (c) applying an aqueous slurry of calcium hydroxide and calcium acetate to said coal.

23. The method of claim 22 wherein calcium formate is used instead of calcium acetate.

24. The method of claim 22 wherein step (b) consists of applying carbon dioxide gas at a pressure in the range from 2 to 10 atmospheres.

25. The method of claim 24 wherein said pressure is applied to said coal for approximately 24 hours.

26. The method of claim 22 comprising an additional step of drying said coal after step (a).

27. The method of claim 26 wherein said drying comprises heating said coal for at least 24 hours at a temperature in the range from 40 to 60 degrees C.

28. The method of claim 22 additionally comprising a final step of washing said coal with water.

29. The method of claim 22 wherein said slurry is applied under pressure in step (c).

* * * * *